US007744176B2

(12) United States Patent
Milligan

(10) Patent No.: US 7,744,176 B2
(45) Date of Patent: Jun. 29, 2010

(54) FRICTION DRAWER SLIDE

(75) Inventor: Charles A. Milligan, Hacienda Heights, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 99 days.

(21) Appl. No.: 11/029,309

(22) Filed: Jan. 4, 2005

(65) Prior Publication Data

US 2005/0116595 A1 Jun. 2, 2005

Related U.S. Application Data

(60) Continuation of application No. 10/911,093, filed on Aug. 4, 2004, now Pat. No. 6,984,008, which is a division of application No. 09/990,903, filed on Nov. 16, 2001, now Pat. No. 6,805,418.

(60) Provisional application No. 60/249,137, filed on Nov. 16, 2000.

(51) Int. Cl.
*A47B 88/00* (2006.01)

(52) U.S. Cl. ..... 312/334.32; 312/334.8

(58) Field of Classification Search ... 312/334.7–334.8, 312/334.16, 334.22–334.24, 334.28, 334.31, 312/334.32, 334.36; 384/20, 23; 108/147.19, 108/147.21

See application file for complete search history.

(56) References Cited

U.S. PATENT DOCUMENTS

| | | | | |
|---|---|---|---|---|
| 3,092,429 A | | 6/1963 | Barnes | |
| 3,133,768 A | * | 5/1964 | Klakovich | 312/334.8 |
| 3,258,299 A | | 6/1966 | Meyer | |
| 3,328,107 A | | 6/1967 | Gutner | |
| 3,589,778 A | * | 6/1971 | Olson | 384/21 |
| 3,981,553 A | * | 9/1976 | Gutner | 312/334.34 |
| 4,560,212 A | | 12/1985 | Papp et al. | |
| 4,752,142 A | * | 6/1988 | Jackson et al. | 384/18 |
| 4,872,734 A | | 10/1989 | Rechberg | |

(Continued)

FOREIGN PATENT DOCUMENTS

| | | |
|---|---|---|
| DE | 35 18 359 | 11/1986 |

(Continued)

OTHER PUBLICATIONS

PCT International Search Report dated Apr. 29, 2002 from corresponding PCT Application No. PCT/US2001/043759 filed Nov. 16, 2001 (5 pgs.).

*Primary Examiner*—Hanh V Tran
(74) *Attorney, Agent, or Firm*—Christie, Parker & Hale, LLP

(57) ABSTRACT

A telescopic drawer slide including first, second and third drawer slides, each having a longitudinal length with a web and arcuate arms along the longitudinal margins of the web, the second drawer slide being nested within the arcuate arms of the first drawer slide, and the third drawer slide being nested within the arcuate arms of the second drawer slide. There is a lock between the second drawer slide and the first drawer slide, the lock having a biased tab rotatably coupled to the second drawer slide and an emboss on the first drawer slide. The tab moves into a portion of the emboss upon movement over the emboss, thereby preventing the second drawer slide from closing relative to the third drawer slide.

19 Claims, 9 Drawing Sheets

U.S. PATENT DOCUMENTS

| | | | | | |
|---|---|---|---|---|---|
| 4,998,828 | A | | 3/1991 | Hobbs | |
| 5,033,805 | A | | 7/1991 | Hobbs | |
| 5,107,775 | A | * | 4/1992 | Langlais et al. | 108/147.21 |
| 5,285,733 | A | * | 2/1994 | Waibel | 108/147.19 |
| 5,379,566 | A | * | 1/1995 | Schworer | 52/632 |
| 5,411,333 | A | * | 5/1995 | Hoffman | 384/18 |
| 5,579,557 | A | * | 12/1996 | Boden | 16/429 |
| 5,722,750 | A | | 3/1998 | Chu | |
| 5,730,514 | A | | 3/1998 | Hashemi | |
| 5,733,026 | A | * | 3/1998 | Munachen | 312/334.12 |
| 5,895,101 | A | * | 4/1999 | Cabrales et al. | 312/334.11 |
| 6,033,047 | A | | 3/2000 | Hoffman | |
| 6,209,979 | B1 | | 4/2001 | Fall et al. | |
| 6,296,338 | B1 | | 10/2001 | Stijns | |
| 6,554,235 | B1 | * | 4/2003 | Fortier | 248/122.1 |
| 6,655,763 | B2 | | 12/2003 | Judge et al. | |
| 6,805,418 | B2 | | 10/2004 | Milligan | |
| 6,817,685 | B2 | | 11/2004 | Lammens | |
| 6,938,967 | B2 | * | 9/2005 | Dubon et al. | 312/333 |

FOREIGN PATENT DOCUMENTS

| | | | | |
|---|---|---|---|---|
| DE | 38 36 273 | A1 | | 4/1990 |
| GB | 2 028 109 | A | | 3/1980 |
| GB | 2130472 | | * | 6/1984 |
| JP | 07039430 | | | 2/1995 |

* cited by examiner

FRICTION DRAWER SLIDE

CROSS-REFERENCE TO RELATED APPLICATION(S)

This application is a continuation of U.S. patent application Ser. No. 10/911,093, filed Aug. 4, 2004 now U.S. Pat. No. 6,984,008 which is a divisional of U.S. patent application Ser. No. 09/990,903, filed on Nov. 16, 2001 now U.S. Pat. No. 6,805,418, which claims the benefit of U.S. Provisional Application No. 60/249,137, filed on Nov. 16, 2000, the contents of each of which are incorporated herein by reference.

BACKGROUND OF THE INVENTION

The present invention relates to drawer slides and more particularly to a telescopic frictional drawer slide.

Telescopic slides for file drawers and the like are often desirable for use in cabinets and other rack mounted applications. Such slides permit easy access to the interior of the drawer. The slides maintain the drawer in a horizontal position regardless of how far the drawer is withdrawn from the cabinet. The slides are also useful in the mounting of extendable shelves and cabinets. A typical drawer will often have two slides securing the drawer to the cabinet or enclosure, with the slides attached to each of the outside vertical walls of the drawer.

Frictional drawer slides typically have members that rub against each other in sliding engagement. One advantage of frictional drawer slides is that there are no ball bearings. One disadvantage of typical frictional drawer slides is noise of operation. Another disadvantage of typical frictional drawer slides is difficulty in opening because of a large amount of friction, especially after wear.

SUMMARY OF THE INVENTION

A telescopic drawer slide according to an embodiment of the present invention includes first, second and third drawer slides each having a longitudinal length with a web, and arms along the longitudinal margins of the web. The second drawer slide is nested within the arcuate arms of the first drawer slide. The third drawer is nested within the arcuate arms of the second drawer slide. The telescopic drawer slide has a lock between the second drawer slide and the first drawer slide, the lock having a biased tab rotatably coupled to the second drawer slide and an emboss on the first drawer slide. The tab moves into a portion of the emboss upon movement over the emboss, thereby preventing the second drawer slide from closing relative to the third drawer slide.

In an embodiment, the tab is biased by gravity. In an alternative embodiment, the tab is biased by a spring. The tab is moved over the emboss by the third drawer slide thereby allowing the second drawer slide to close relative to the first drawer slide after closing of the third drawer slide relative to the second drawer slide.

In an embodiment, the emboss has an angled portion tapering toward the arcuate arms of the first drawer slide, a wide portion with longitudinal edges, and an edge leading to a narrow portion. As the second drawer slide is withdrawn from the first drawer slide, the tab moves to the narrow portion and is restrained by the edge from closing.

The web of the second drawer slide has a hat section extending along the longitudinal length. The hat section of the second drawer slide clearing the emboss on the first drawer slide. The web of the third drawer slide has a hat section extending along the longitudinal length. The hat section of the third drawer slide clearing and surrounding the hat section of the second drawer slide.

In an embodiment, the arms of the first drawer slide have a lateral portion that is bowed toward the arms of the second drawer slide. The arms of the second drawer slide are nested within the arms of the first drawer slide defining a contact area along a tip of the bowed portion of the arms and a reservoir adjacent to the contact area.

In another additional embodiment, the arms of the third drawer slide have a lateral portion that is bowed toward the arms of the second drawer slide. The arms of the third drawer slide are nested within the arms of the second drawer slide defining a contact area along a tip of the bowed portion of the arms of the third drawer and a reservoir adjacent to the contact area.

In an additional embodiment, the telescopic drawer slide has a lock between the third drawer slide and the second drawer slide. The lock has a biased tab on the third drawer slide and a hole in the second drawer slide. The biased tab enters the hole when the third drawer slide is withdrawn from the second drawer slide.

In an alternative embodiment, the lock between the third drawer slide and the second drawer slide has a biased arm with a cutout rotatably coupled to the third drawer slide and a tab on the second drawer slide oriented toward the third drawer slide. The tab enters the cutout as the third drawer slide is withdrawn from the second drawer slide. In an additional embodiment, a lock release moves the biased arm to move the cutout away from the tab.

Additionally, a telescopic drawer slide according to an embodiment has a stop between the second drawer slide and the first drawer slide. A portion of the web of the second drawer slide is punched toward the first drawer slide and a portion of the vertical web of the first drawer slide is punched toward the second drawer slide.

In an alternative embodiment, the lock between the second drawer slide and the first drawer slide has a lever biased toward the first drawer slide coupled to the second drawer slide, a tab coupled to the lever, and a hole in the first drawer-slide. The tab moves into the hole in the first drawer slide as the second drawer slide is withdrawn from the first drawer slide, thereby preventing the second drawer slide being closed relative to the first drawer slide. In an additional embodiment, a c-shaped tab is formed in the web of the third drawer slide. The c-shaped tab is biased toward the second drawer slide. The c-shaped tab moves the lever and the tab away from the first drawer slide allowing the second drawer slide to be closed relative to the first drawer slide member.

In yet another embodiment, the telescopic drawer slide has a detent. The detent includes a hole in the lever of the second drawer slide and a raised bump on the c-shaped tab of the third drawer slide. When the third drawer slide is closed within the second drawer slide, the bump fits inside of the hole in the lever. The detent prevents movement of the third drawer slide relative to the second drawer slide until a predetermined amount of force is used to pull the third drawer slide from the second drawer slide. The detent causes the second drawer slide to be withdrawn from the first drawer slide prior to the withdrawing of the third drawer slide from the second drawer slide.

A telescopic drawer slide according to an embodiment of the present invention fits within a space between a drawer and a cabinet of about 0.375 inches wide by about 1 inch in height.

BRIEF DESCRIPTION OF THE DRAWINGS

Other features and advantages of the preset invention will be set forth in part in the description which follows and in the accompanying drawings, wherein.

DETAILED DESCRIPTION OF THE INVENTION

Figure 1:
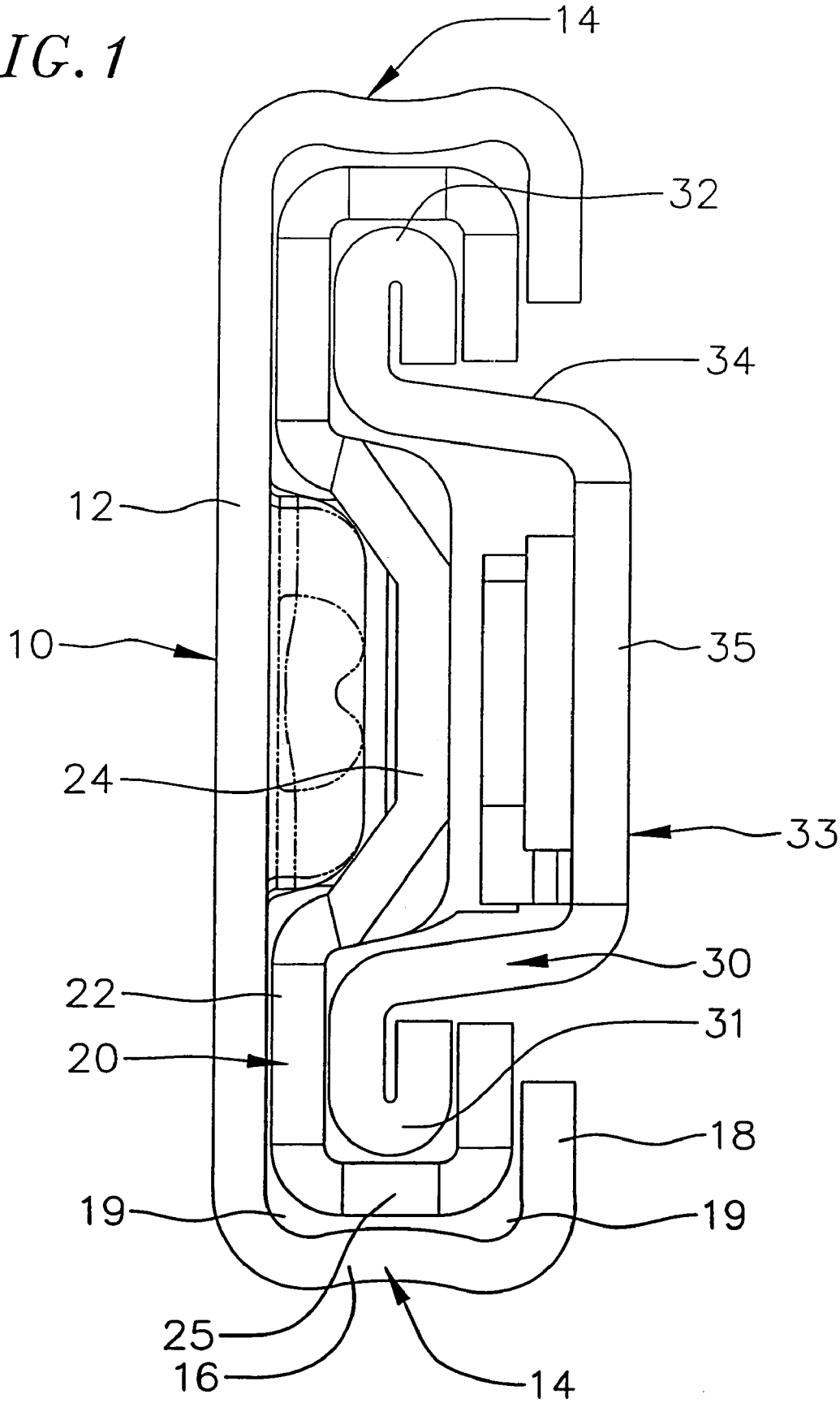
FIG. 1 is a cross-section view of a telescopic drawer slide according to an embodiment of the present invention.

A drawer slide incorporating the present invention is shown in FIG. 1. As shown in FIG. 1, an exemplary drawer slide has three separate slide members. The three slide members shown in FIG. 1 are an outer slide member 10, an intermediate slide member 20, and an inner slide member 30. The three slide members are all slidably connected to one another. In alternative embodiments, the drawer slide has 4 or more slide members.

In the following description, it is assumed that the inner slide member is attached to a drawer and the outer slide member is attached to a cabinet. In practice, the outer slide member may be attached to a drawer and the inner slide member may be attached to a cabinet. Furthermore, the same drawer slide according to an embodiment of this invention, can be mounted on either side of the drawer without any modification.

The slide members fit within each other when the drawer is closed. In an embodiment, the drawer slide, in a closed position, fits inside of a space between the drawer and the cabinet having a size of approximately 0.375 inches wide by approximately 1 inch in height. In order to achieve this, the slide members increase in thickness from inner to intermediate to outer member. The inner slide member 30 nests within the intermediate slide member 20 which in turn nests within the outer slide member 10. As shown in FIG. 1, the outer slide member 10 has an outer vertical web 12 and two outer slideways 14. Each slideway has a horizontal portion 16 extending from the outer vertical web toward the drawer, and a vertical portion 18 that is oriented inward. The horizontal and vertical portions of the slideway in combination with a portion of the outer vertical web 12 encompass intermediate slideways of the intermediate slide member 20.

The horizontal portions 16 of the outer slideways are slightly concave inward. In the shown exemplary embodiment, the horizontal portions 16 are bowed inward defining bowed lateral portions, where the entire bowed lateral portions have a generally constant radius of curvature. As explained below, the bowed in horizontal portions 16 of the outer slide member are slid upon by the outside of intermediate slideways of the intermediate slide member 20. The outside of the intermediate slideways of the intermediate slide member 20 contact only the top of the curve in the middle of the horizontal portions 16 of the outer slide member 10. This reduces friction between the outer slide member 10 and the intermediate slide member 20. Likewise, because the outer slideways are bowed inward, small pockets 19 are formed in slideway edges where the outer vertical web 12 meets the horizontal portion 16 and where the horizontal portion 16 meets the vertical portion 18. The small pockets 19 run all along the length of the outer slide member 10 and function as reservoirs for lubricating material. The small pockets 19 also function as a depository for minute particles of materials produced during the wear of mating surfaces during use of the slide.

The outer vertical web 12 of the outer slide member 10 contains a number of holes that allow the outer slide member to be attached to either a cabinet or to a drawer. In an embodiment of the present invention, the outer slide member is attached to the cabinet using screws. In alternative embodiments, the outer slide member is attached using other attachment devices, such as nails, nuts, glue, and rivets. In yet another alternative embodiment of the present invention one or more brackets may be attached to the outer slide member, with the brackets themselves being attached to a cabinet or drawer.

The intermediate slide member 20 has intermediate slideways 25. The intermediate slideways 25 are formed with a horizontal section attached to the intermediate vertical web 22. Each slideway has a vertical section facing the opposite slideway. The horizontal section and vertical section, in combination with the intermediate vertical web, forms an enclosed space that encloses slider sections of the inner slide member 30. In contrast to the horizontal portion of the slideways of the outer slide member 10, the horizontal portions of the intermediate slideways 25 are not concave. The inside of the intermediate slideways 25 contain sharp corners. The outside corners of the intermediate slideways are curved to help form the pockets 19 on the inside of the outer slideways discussed above.

The intermediate slide member 20 also has an intermediate vertical web 22. A portion of the intermediate vertical web 22 in the vertical center of the slide member is bent toward the drawer to form a hat section 24. The hat section 24 has two angled portions leading from the intermediate vertical web to a vertical portion that is positioned closer to the drawer than the intermediate vertical web. The hat section is designed to fit over the screws or other means used to attach the outer slide member to a cabinet or drawer. Additionally, the hat section adds strength and stability to the intermediate slide member. In one embodiment, the hat section is recessed inward enough to clear the heads of number 8 screws or equivalent screw heads.

The inner slide member 30 has slider sections 31 that slide inside of the intermediate slideways of the intermediate slide member. The slider sections 31 are made of a vertical piece that has been bent 180 degree back upon itself, forming an edge 32 which slides on the inside of the intermediate slideway 25. The edge 32 provides for point contact between the inner slide member 30 and the intermediate slide member 20, reducing friction and the force necessary to extend and retract the inner slide member.

The inner slide member also has an inner hat section 33. The inner hat section 33 has angled sides 34 leading to a vertical portion 35. In an embodiment of the present invention, the vertical portion 35 of the inner slide member contains holes for attachment to either a cabinet or a drawer. In one embodiment, the inner slide member is attached using screws. In alternative embodiments, the inner slide member may be attached using other attachment devices, such as nails, nuts, glue, and rivets. The hat section 33 of the inner slide member is raised far enough away from the hat portion of the intermediate slide member to allow clearance of a number 8 screws or equivalent screw head. The hat section 33 of the inner slide member 30 is raised far enough away from the hat portion of the intermediate slide member to prevent contact between the hat sections of the intermediate and inner slide members.

The inner slide member has two ends. A first end is facing out from a closed position and forms one end point of the slide as it is opened. The first end of the inner slide member has a tab across the hat section. The tab functions as a stop because the tab is hit by the intermediate slide member when the inner slide member is fully closed.

Figure 2:
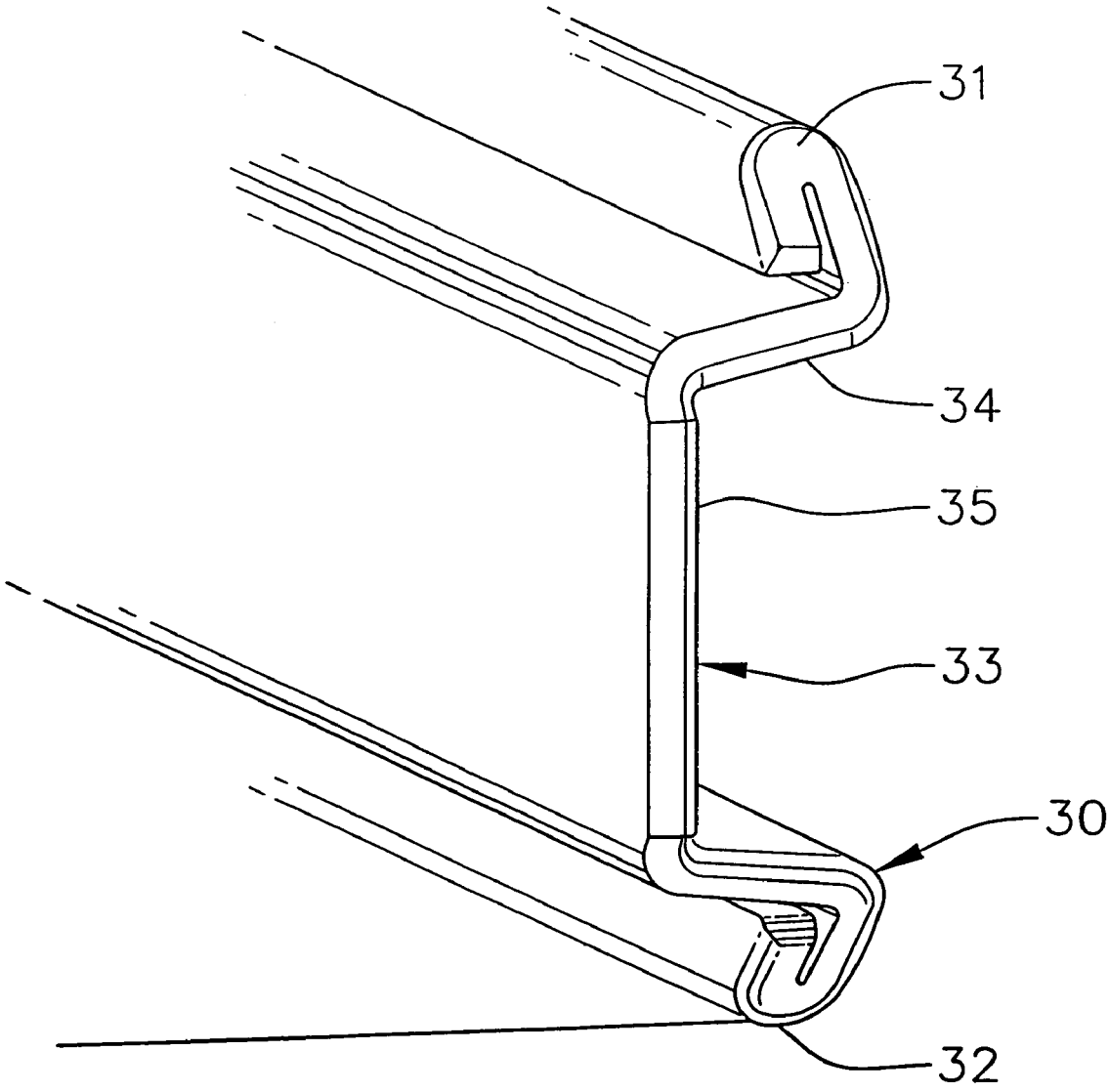
FIG. 2 is a perspective view of a leading edge of an inner slide member according to an embodiment of the present invention.

A second end of the inner slide member is opposite to the first end. The inner slide member is removable from the intermediate slide member. After removal from the intermediate slide member, the second end of the inner slide member must be oriented to the intermediate slide member for reinsertion. As shown in FIG. 2, the second end of the inner slide member is tapered, and therefore the ends of the sliders are angled back into the inner slide member. The tapered second end of the inner slide member allows the slide member to align with an end of the intermediate slide member. The second end of the inner slide member is also chamfered to further assist in alignment between the inner slide member and the intermediate slide member.

The tapered second end is provided for in the preformed shape of the inner slide member. The taper eliminates the need to remove burrs caused by shearing the inner slide member. This is advantageous because the presence of burrs may lead to pre-mature failure of the surface, thus increasing interference and later increasing the force required to move the inner slide member during drawer slide use.

The inner, intermediate, and outer slide members slide in relation to one another. In order to keep a drawer sliding evenly on both sides, the drawer slides are designed to open and close the same way in a process which may be termed sequencing. By using locks and detents, further described below, the intermediate slide member 20 is pulled out of the outer slide member 10 first. Once the intermediate slide member 20 has been fully extended from the outer slide member 10, the inner slide member 30 is released from the intermediate slide member 20. Likewise, when closing a drawer slide, the inner slide member 30 is closed back inside of the intermediate slide member 20. After the inner slide member 30 is completely inside of the intermediate slide member 20, the intermediate slide member 20 is released to close into the outer slide member 10.

In an alternative embodiment of the present invention, the inner slide member 30 opens from the intermediate slide member 20 before the intermediate slide member opens from the outer slide member 10. Likewise, in the alternative embodiment, the intermediate slide member 20 closes inside of the outer slide member 10 before the inner slide member 30 closes inside of the intermediate slide member 20.

Figure 3:
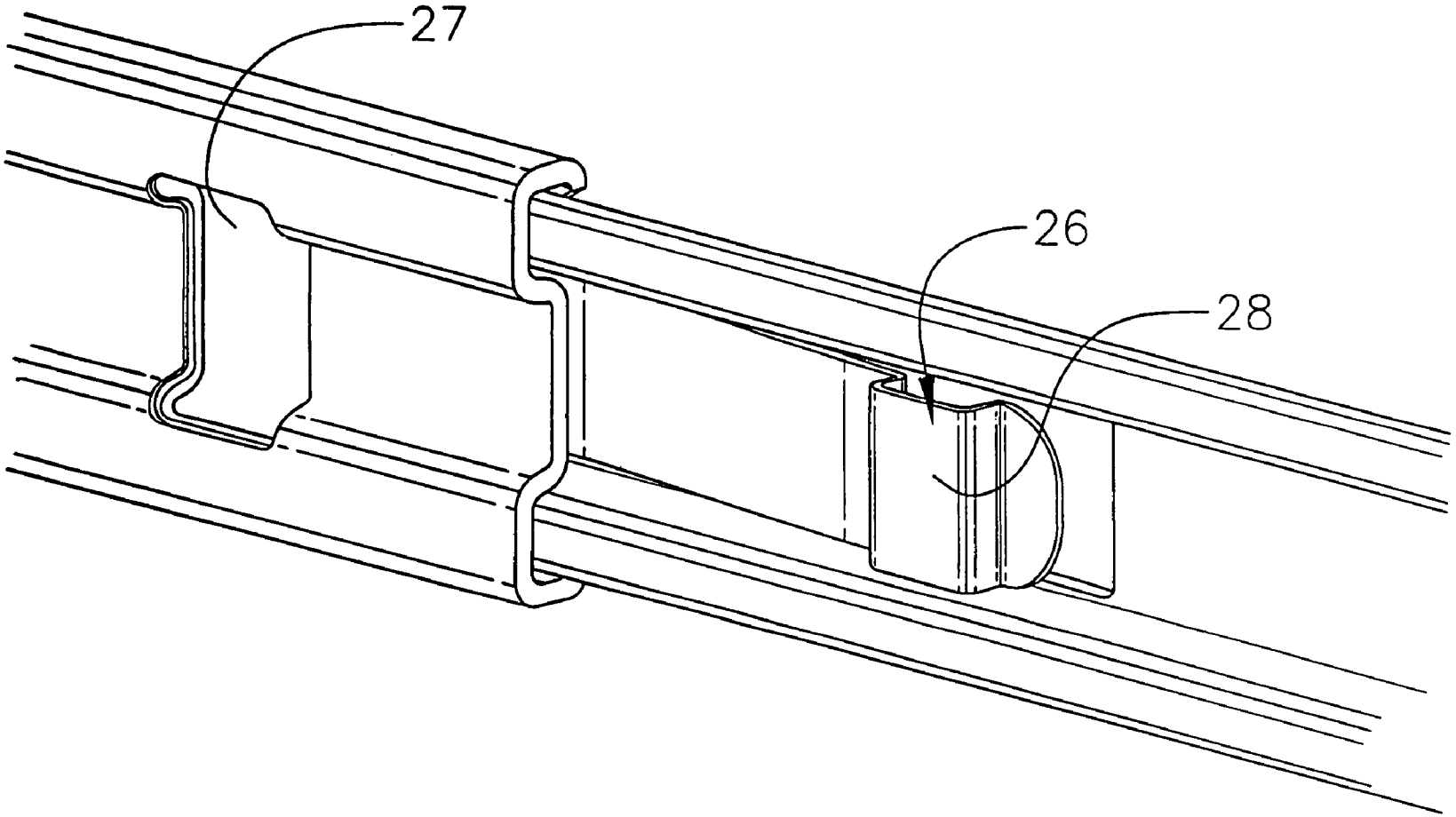
FIG. 3 is a perspective view of a lock between the inner slide member and the intermediate slide member according to a first embodiment of the present invention.

In a first embodiment of the present invention, shown in FIG. 3, a lock is placed between the inner slide member 30 and the intermediate slide member 20 so that someone cannot pull the inner slide member 30 out of the intermediate slide member 20 beyond a preselected point. In the first embodiment, the inner slide member has a spring formed stop 26 located approximately one third of the way from the second end of the inner slide member on the inside of the inner slide member. The spring formed stop has a first portion that extends toward the intermediate slide member 20 from the inner slide member. At the end of the first portion is a rectangular portion 28. The rectangular portion 28 is biased toward to the intermediate slide member by the first portion.

The intermediate slide member has a hole 27 to catch the rectangular section of the spring formed stop. The intermediate slide member has two ends. A first end of the intermediate slide member is oriented to the second end of the inner slide member when the inner slide member is extended. In an embodiment of the present invention, the hole 27 that catches the spring formed stop is positioned near the first end of the intermediate slide member. A second end of the intermediate slide member is oriented opposite to the first end of the intermediate slide member.

As the spring formed stop passes over the hole 27 in the intermediate slide member, the spring formed stop springs into the hole. Once in the hole, the spring formed stop impacts the edge of the hole in the intermediate slide member and prevents the inner slide member from being further extended from the intermediate slide member. This prevents accidental removal of the inner slide member of the intermediate slide member and thus, the accidental removal of the drawer from the cabinet. The removal of the inner slide member from the intermediate slide member, and hence the removal of the drawer from the cabinet is possible, by manually pressing the spring formed stop 26 out of the hole 27 in the intermediate slide member.

The placement of the spring formed stop 26 also creates staging, because once the inner slide member is totally extended, and the spring formed stop 26 is in the hole 27 of the intermediate slide member, all of a drawer opening force pulls the intermediate slide member 20 out of the outer slide member 10.

In an additional embodiment of the present invention, the hole 27 in the intermediate slide member and the spring formed stop 26 are designed so that the spring formed stop does not catch the edge of the hole when the drawer is being closed. Therefore, the spring formed stop does not prevent the inner slide member from closing inside of the intermediate slide member.

Figure 4A:
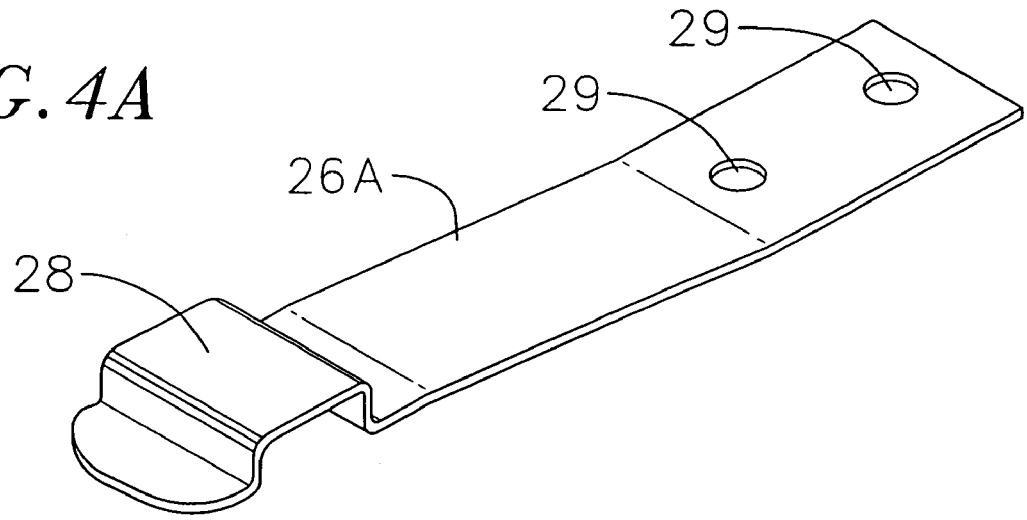
FIGS. 4*a* to 4*c* show top views of alternative spring formed stops according to a first embodiment of the present invention.
Figure 4B:
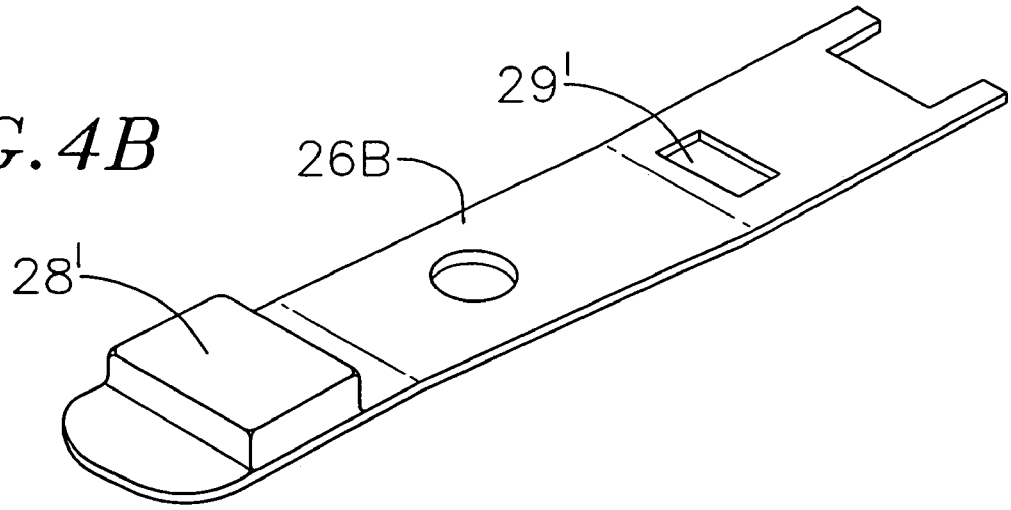
Figure 4C:
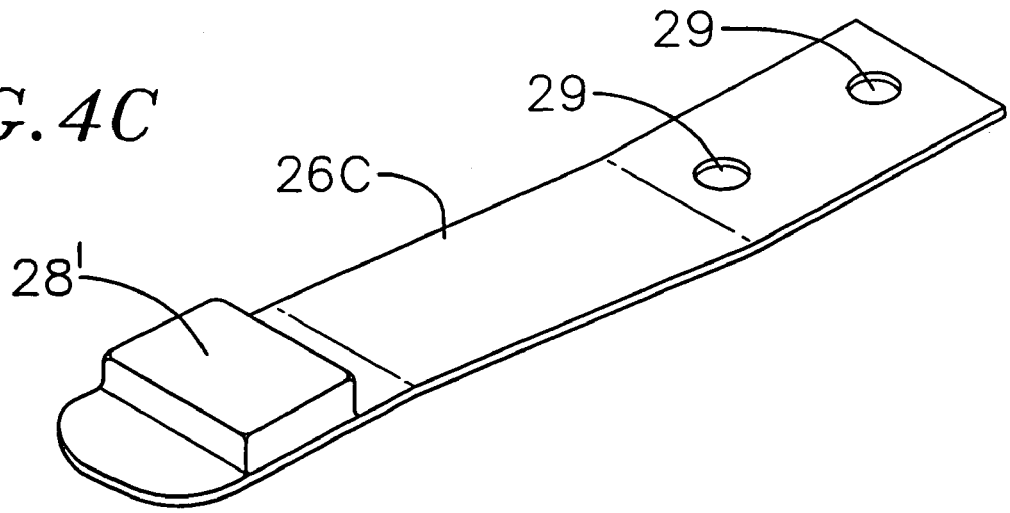

As shown in FIGS. 4*a* to 4*c*, a spring formed stop 26A-26C is attached to the inner slide member. In an embodiment, shown in FIG. 4*a*, the rectangular portion 28 is formed as a rectangular stamping. In an alternative embodiment, shown in FIGS. 4*b* and 4*c*, the rectangular portion is a three dimensional rectangular structure 28' attached to the first portion of the spring formed stop. The spring formed stop 27 may be attached using one or more fasteners, such as rivets, that go through one or more holes 29/29' in the spring formed stop and one or more holes in the inner slide member. Alternatively, the spring formed stop may be attached by staking, where a portion of the inner slide member is stamped to fit around the spring formed stop.

Figure 5:
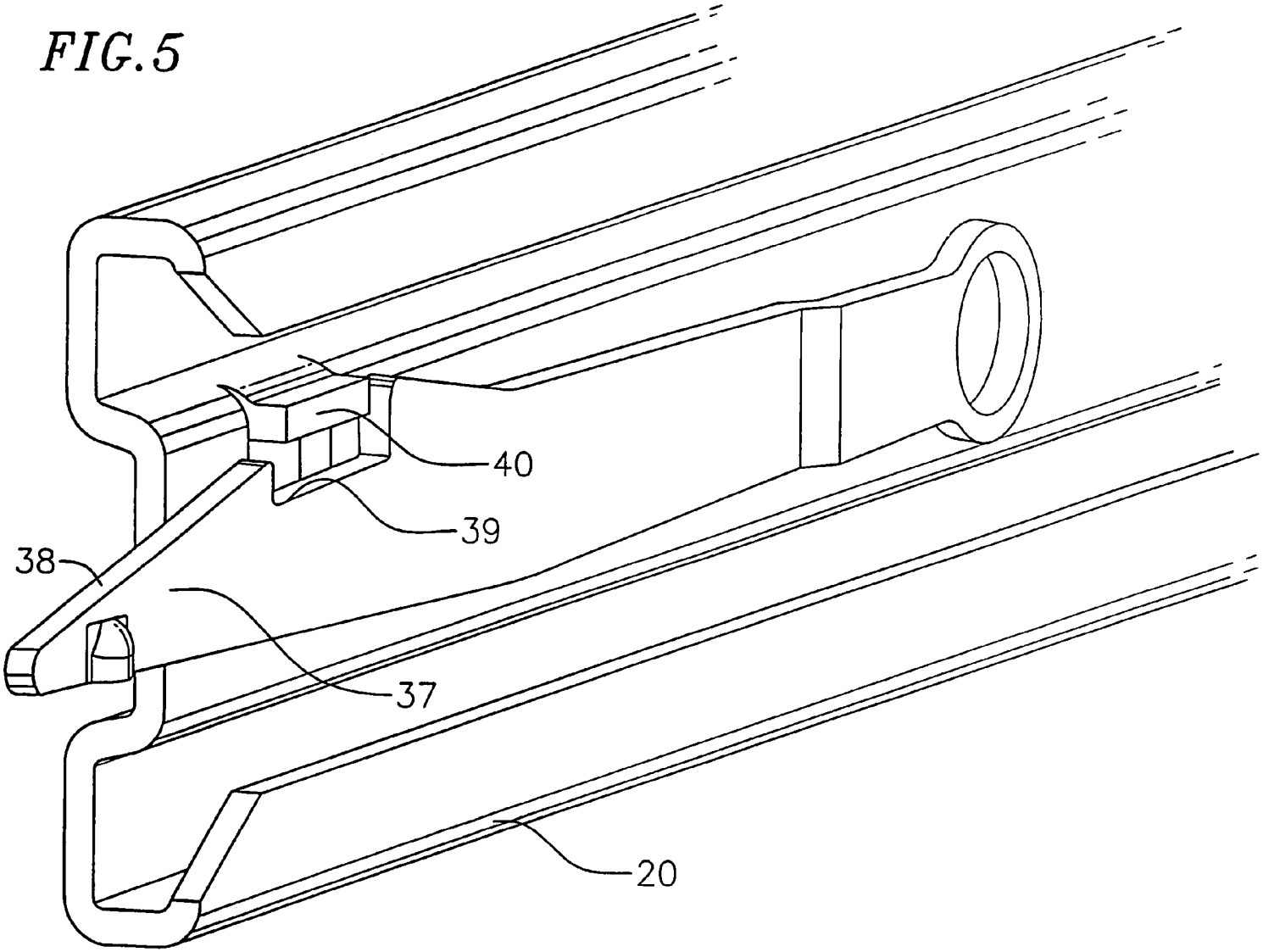
FIG. 5 is an elevational view taken from a side of a drawer slide showing the locking mechanism between the inner and intermediate slide members according to a second embodiment of the present invention.

In a second embodiment of the present invention a different type of lock is used between the inner and intermediate slide members. In this alternative embodiment, shown in FIG. 5, the lock, once initiated, prevents the inner slide member from being opened further or closed in relation to the intermediate slide member.

In the second embodiment of the present invention, the inner slide member has a spring biased lever 37 positioned inside of the inner hat section. The lever 37 has an angled portion 38 that is oriented outward. The lever also has a square cut out 39 along an edge adjacent to the intermediate slide member. A spring biases the lever 37 so that the square cut out 39 is always being pressed outwards toward the intermediate slide member 20. In an embodiment of the present invention, the lever 37 is attached to the inner slide member 30 by means of a rivet. In alternative embodiments, the lever may be attached using nuts and bolts, screws, or other means of attachment, that allow the lever to rotate around the point of attachment.

Also in the second embodiment of the present invention, the intermediate slide member 20 has a segment of the angled portion of the hat section 24 stamped inward. The inward stamped portion extends into the hat section 33 of the inner slide member 30 forming a protrusion 40. As the inner slide member 30 and the attached spring biased lever 37 passes the protrusion 40 of the intermediate slide member, the angled portion 38 of the lever is pressed downward due to the angle of impact. The force necessary to further move the inner slide member and the lever may be manipulated by changing the strength of the spring biasing the lever. The lever continues to be pushed against the force of the spring until the square cut out 39 of the lever is positioned over the protrusion 40 of the intermediate slide member 20. At this point, the force of the spring forces the lever down over the protrusion, and the lever is locked in place. In order to release the inner slide member from the lock, the lever must be moved over the protrusion. In an embodiment of the present invention, a user simply pushes the lever against the spring force, thus moving the lever over the protrusion and allowing the inner slide member to be either opened or closed.

Figure 6:
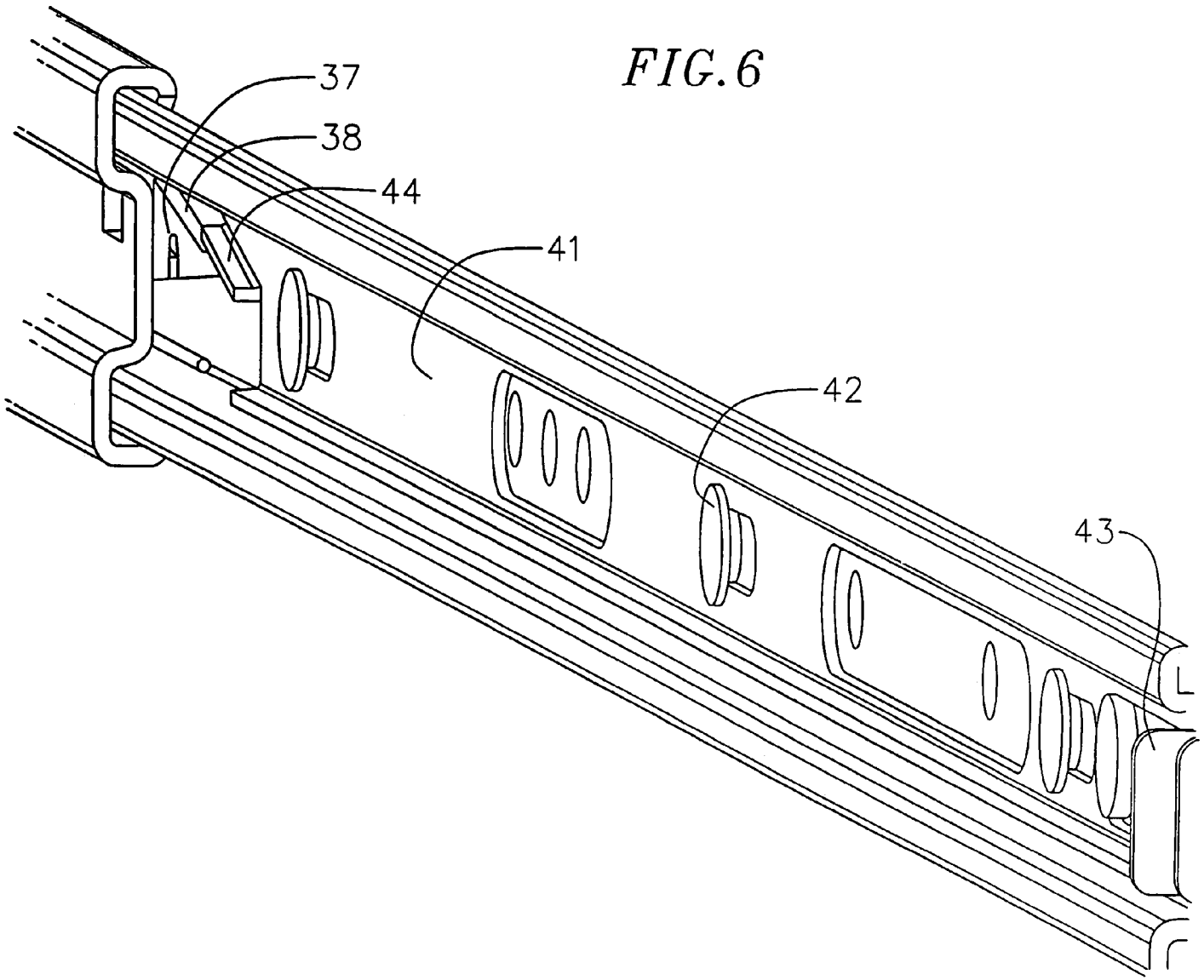
FIG. 6 is a perspective view of the locking relationship between the inner and intermediate slide members according to a second embodiment of the present invention.

In an alternative embodiment, shown in FIG. 6, attached to the inner slide member is a release lever 41 that releases the lock. The release lever 41 is attached to the inner slide member 30 with shoulder rivets 42. The use of shoulder rivets allows the release lever to be translated, along the length of the inner slide member. Pushing the release lever 41, particularly along a tab 43 at a forward end of the release lever 41, causes an end 44 of the release lever 41 to press against the angled edge 38 of the lever 37. This results in a rotation of the lever 37 such that the square surface 39 of the lever 37 is rotated over the protrusion 40, thus releasing the lock.

Figure 7:
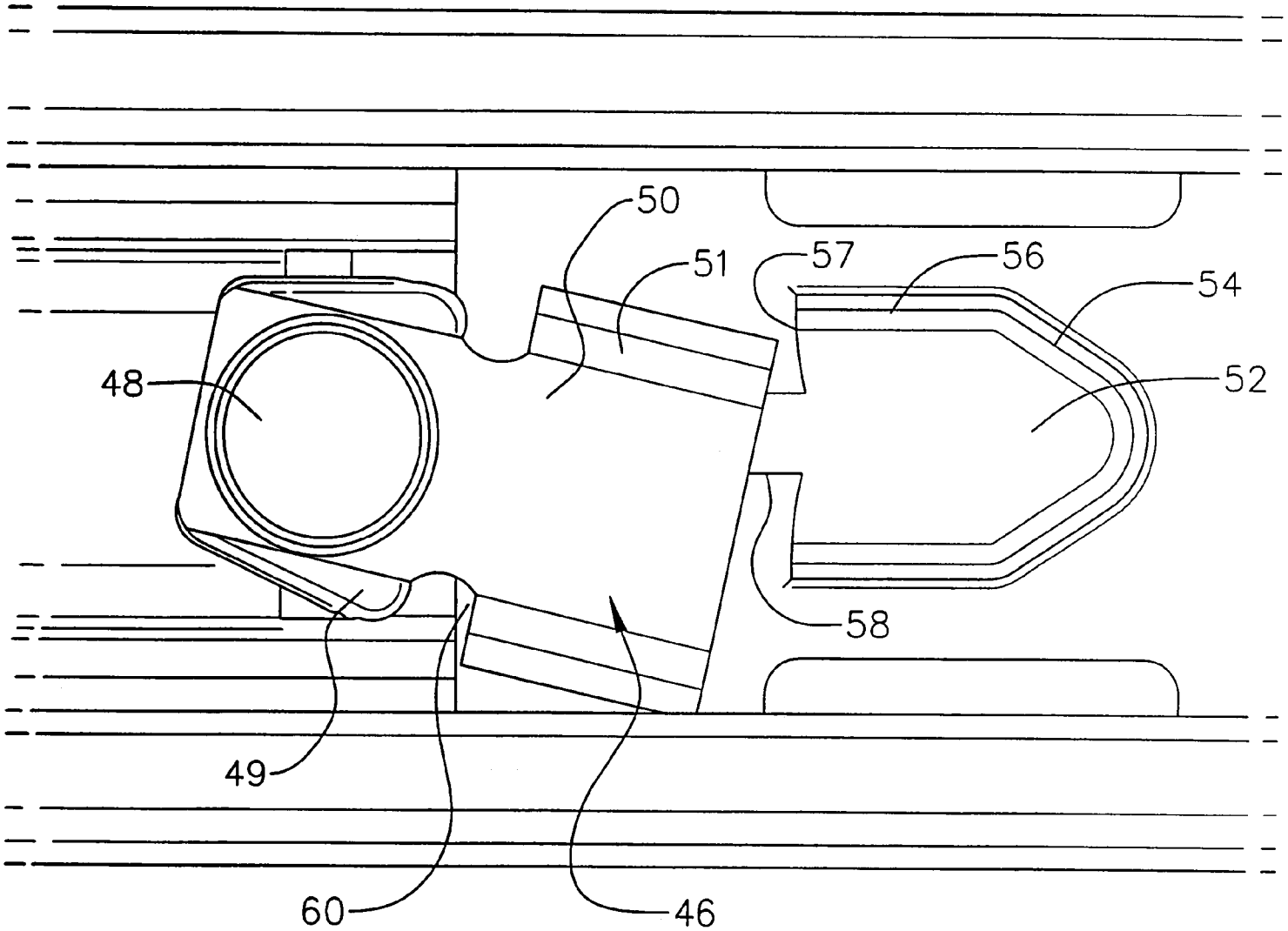
FIG. 7 is another perspective view of a lock between the intermediate slide member and the outer slide member according to an embodiment of the present invention.

A locking mechanism also exists between the intermediate slide member and the outer slide member. The locking mechanism prevents the intermediate slide member from closing inside of the outer slide member until the inner slide member is closed inside of the intermediate slide member. As shown in FIG. 7, in an embodiment of the present invention, a tab 46 is attached to the second end of the intermediate slide. The tab is "T" shaped. The tab 46 is attached using a rivet 48. In alternative embodiments, the tab 46 may be attached using other attachments means that allow the tab to rotate around the point of attachment, such as a nut and bolt.

The "T" shape provides a rotational limit for the tab, because the top of the "T" impacts the slideways of the outer slide member. The tab is moved by the force of its own weight depending on the orientation of the slide. This allows the slide to be used on either the left or right side of a drawer, and allows the slide to be affixed with either the outer slide member or the inner slide member attached to a drawer.

The tab 46 has a first area 49 adjacent to the attachment that flares to a larger width toward the second end of the intermediate slide member. The tab has a second area 50 that extends outward from the end of the intermediate slide member. The second area forms the top of a "T" shape and has edges 51 that are folded down to impact an emboss 52 located on the outer slide member. When in a neutral position the second area extends out from the intermediate slide member in parallel to the intermediate slide member. When biased by the weight of the tab 46, the second area slopes downward on an angle and locks in the emboss. When locked in the emboss 52, the angle of the second area of the tab is such that the tab blocks the path of the inner slide member. The inner slide member impacts the angled second area and the angle of impact forces the tab back to a neutral position, thus enabling the tab to clear the emboss 52.

The tab 40 also has reliefs 60 between the first and second area. The reliefs 60 are small cutouts in the tab. The reliefs 60 prevent distortion of the second end of the intermediate slide member which impacts the tab when the tab is engaged in the emboss 52 on the outer slide member 10.

The emboss 52 on the outer slide member 10 functions as a stop for the tab 46 on the intermediate slide member 20. The emboss 52 is arrow shaped with the arrow head pointing toward the closed position. Thus, the emboss 52 has an angled portion 54, a horizontal portion 56 and a vertical edge 57 from the horizontal portion to a narrow stem 58.

As the intermediate slide member is extended, the angled head of the emboss 52 allows the tab 46 to pass over the angled portion 54 and onto the horizontal portion 56 despite the weight of the tab. Once past the horizontal portion 56, the tab reaches the vertical edge 57 and narrow stem and the weight of the tab forces the tab down the vertical edge 57 against the narrow stem 58. When a closing force is applied to the intermediate slide member, the downward angled second area of the tab impacts the vertical edge 57 of the emboss and is immobile until the inner slide member acts on the downward angled second area of the tab to return the tab to the neutral position. The force of the inner slide member counteracts the weight of the tab and pushes the tab upward so that the tab can then clear the emboss 52. Once clear of the emboss 52, the intermediate slide member 20 may close inside of the outer slide member.

In an additional embodiment of the present invention, the horizontal edge 56 transitions into an edge more than 90 degree inward. The additional angle beyond 90 degrees prevents the tab from disengaging from the emboss due to vibration, bounce or excessive force.

A lock is present to prevent the intermediate slide member 20 from coming completely out of the outer slide member 10. Near the second end of the intermediate slide member, a portion of the angled sides of the hat section of the intermediate slide section are punched downward toward the outer slide member 10 forming a stop.

The outer slide member has a portion in the outer vertical web 12 punched upward toward the intermediate slide member 20 that prevents the downward punched area of the intermediate slide member from moving past. In an embodiment, the raised portion of the vertical web of the outer slide member has a hole where two strips of metal are oriented toward the intermediate slide member. The two strips of metal impact the downward punched areas of the intermediate slide member. This prevents the accidental removal of the intermediate slide member from the outer slide member.

Figure 8:
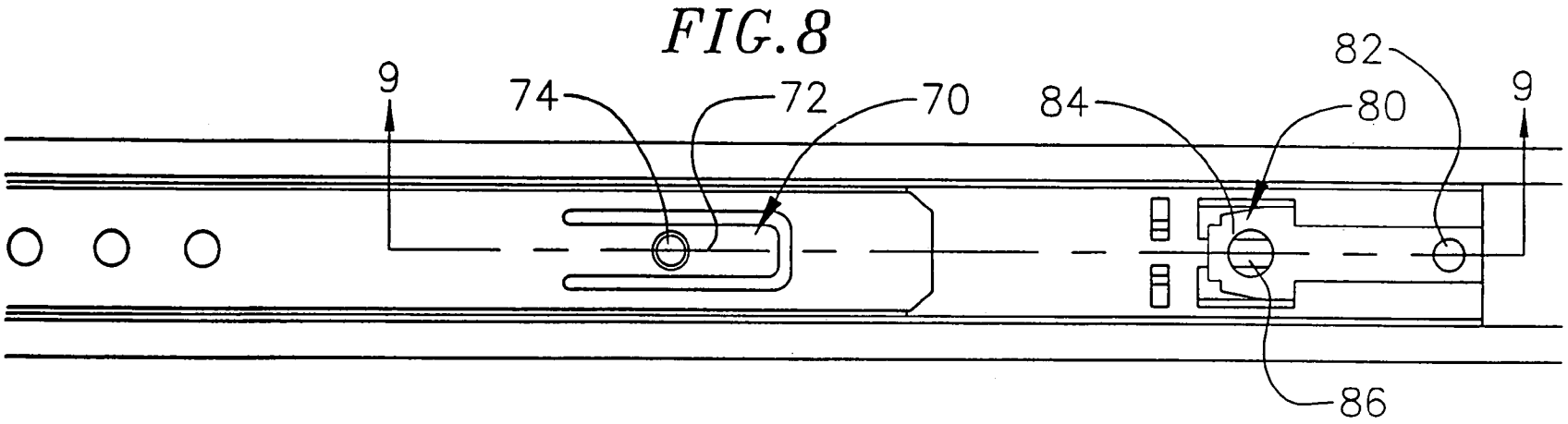
FIG. 8 is a perspective view showing a lock between the intermediate slide member and the outer slide member according to an alternative embodiment of the present invention.
Figure 9:
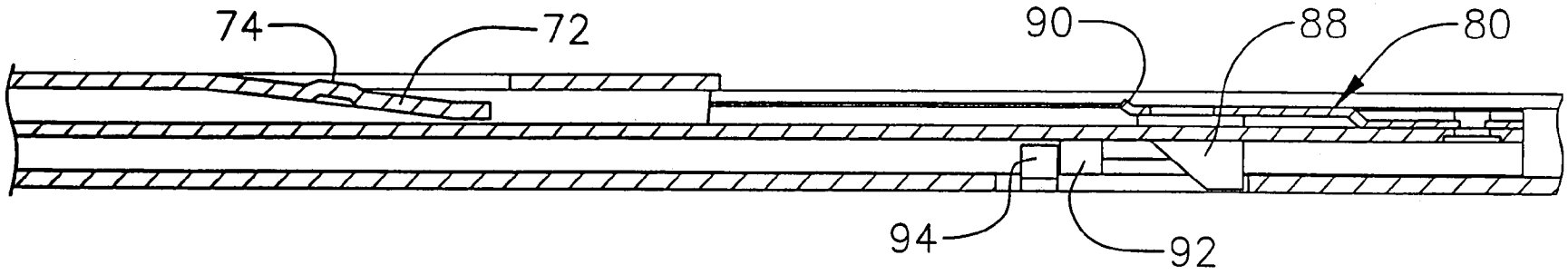
FIG. 9 is a cross-sectional view taken along line A-A of FIG. 8.
Figure 10:
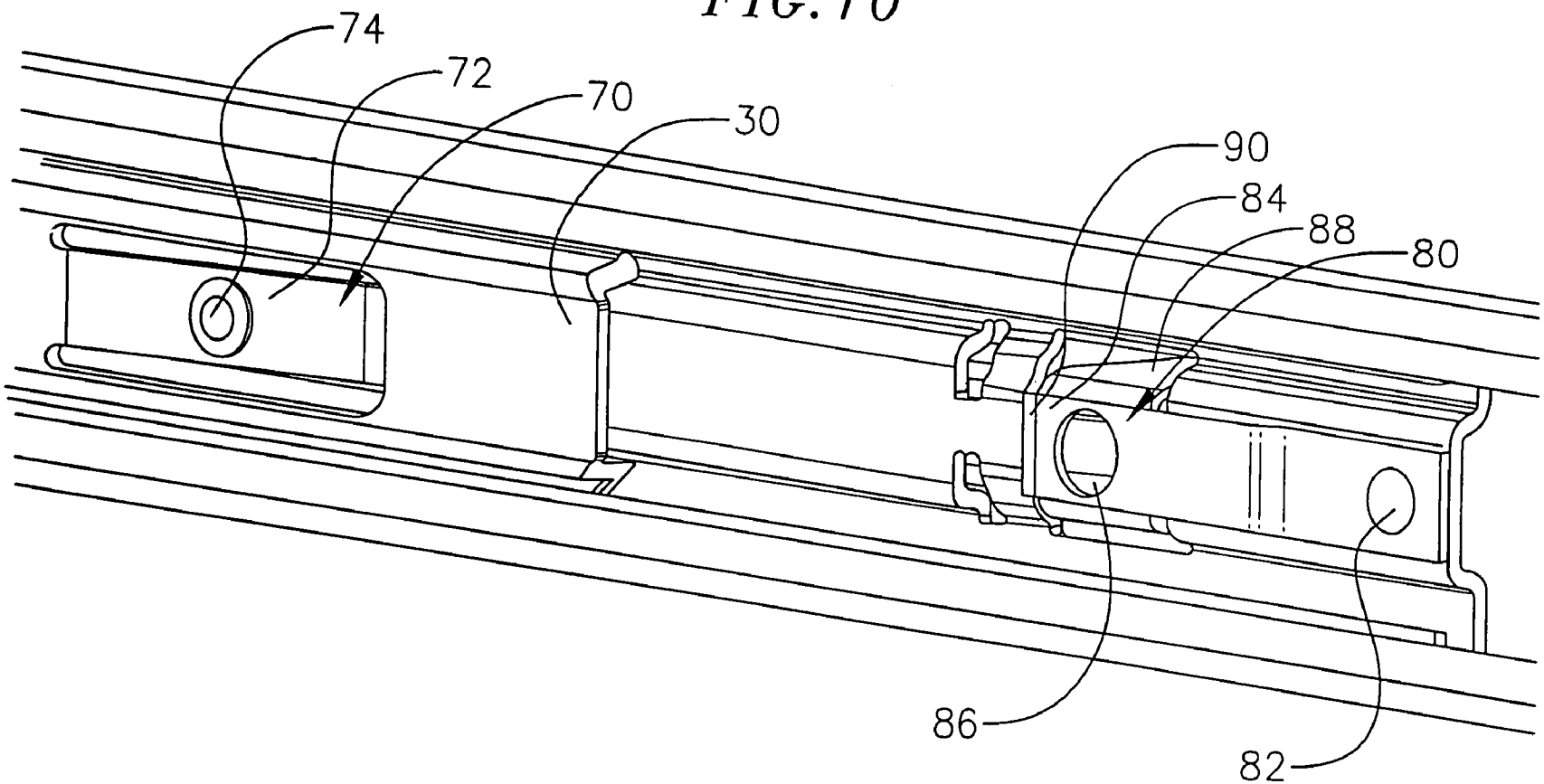
FIG. 10 is a perspective view of a lock between the intermediate and outer slide members according to an alternative embodiment of the present invention.

In an alternative embodiment of the present invention, a different lock is used to force the inner slide member 30 to close inside of the intermediate slide member 20, before the intermediate slide member 20 closes inside of the outer slide member 10. As shown in FIGS. 8, 9, and 10, the vertical portion 38 inner slide member, at a point near the second end, has a "c-shaped" cutout section 70. Within the "c-shaped" cutout section 70 is a tab 72. The tab 72 is bent toward the intermediate slide member 20. On the tab 72 is a button 74.

Attached to the intermediate slide member 20 near the second end of the intermediate slide member 20 is a receiver 80. The receiver 80 is attached to the intermediate slide member using a rivet 82. In an additional embodiment, the receiver 80 may be attached using nuts and bolts, screws, or other means of attachment that allow the receiver to flex inward and outward in relation to the intermediate slide member 20.

The receiver 80 extends from the point of attachment toward the first end of the intermediate slide member. The receiver has a head 84 with a hole 86 in it. The head 84 also has flanges 88 which extend through a hole in the intermediate slide member to the outer vertical web 12 of the outer slide member 10. The flanges are straight on the side closer to the second end of the intermediate slide member, and angled on the other side. The receiver has a springlike aspect and keeps the flanges in contact with the outer slide member. At the end of the receiver closest to the first end of the intermediate slide member, the receiver 80 has a lip 90 upturned toward the inner slide member. The upturned lip helps to guide the "c-shaped" tab 82 into the receiver.

The outer slide member has a hole punched through the outer vertical web 12. When the intermediate slide member 20 and the attached receiver 80 pass over the hole in the outer vertical web, the flanges lodge themselves in the hole in the outer vertical web. As the intermediate slide member 20 is pushed back into the outer slide member 10 the flanges 88 prevent the intermediate slide member from moving.

The receiver catches the tab 74 on the inner slide member 30, as the inner slide member 30 reaches a closed position within the intermediate slide member 20. The inner slide member 30 is forced to slide into the intermediate slide member first because the flanges 88 lock the intermediate slide member in place. Once the inner slide member reaches the closed position of the intermediate slide member, the "c-shaped" tab 72 enters the receiver 80 and pulls the receiver 80 toward the inner slide member 30. The pulling of the receiver 80 moves the flanges 88 out of the hole in the outer vertical web 12 and allows the intermediate slide member to be closed into the outer slide member.

Once the "c-shaped" tab 72 of the inner slide member 30 enters the receiver 80, the button 74 on the "c-shaped tab" 72 engages in the hole 86 of the receiver 80 forming a detent. A significant amount of force is required to move the button 74 out of the hole 86. This allows staging in reverse, because the drawer opening force will first pull the intermediate slide member 20 out of the outer slide member 10. Once the intermediate slide member 20 is pulled out of the outer slide member 10, then a drawer opening force disengages the button 74 from the hole 86 of the receiver 80. Once the button 74 disengages from the hole 86, the inner slide member 30 may be extended from the intermediate slide member 20.

In order to prevent the intermediate slide member 20 from being pulled all the way out of the outer slide member an additional lock is provided. At a point between the receiver 80 and the first end of the intermediate slide member, the hat section of the intermediate slide member is punched toward the outer slide member 10 to create two tabs 92 extending toward the outer slide member. A portion of the outer vertical web 12 is punched in to create tabs 94 that extend up into the hat section of the intermediate slide member 20. The tabs 94 of the outer slide member impact the tabs 92 of the intermediate slide member 20 as the intermediate slide member is pulled out of the outer slide member. The tabs prevent the intermediate slide member from being removed from the outer slide member.

Each of the three slide members contain bends in them to maximize the stiffness and stability of each slide member across its length. The clearance between each of the slide members is designed to be a minimum so that the material thickness of each slide can be maximized for strength, rigidity and wear. The small clearance between each slide member prevents play and interference between slide members.

In an embodiment of the present invention, each of the slide members is formed through roll forming. Roll forming allows the slides to be inexpensively, and quickly mass produced. Roll forming also provides consistency in the characteristics of the drawer slides.

Although this invention has been described in certain specific embodiments, many additional modifications and variations will be apparent to those skilled in the art. It is therefore to be understood that this invention may be practiced otherwise and as specifically described. Thus, the present embodiments of the invention should be considered in all aspects as illustrative and not restrictive.

What is claimed is:

1. A telescopic drawer slide comprising:

a first drawer slide having a longitudinal length with a web and slideways along the longitudinal margins of the web;

a second drawer slide having a longitudinal length with a web and slideways along the longitudinal margins of the web, the second drawer slide being nested within the slideways of the first drawer slide;

a third drawer slide having a longitudinal length with a web, the third drawer slide being nested within the slideways of the second drawer slide; and wherein the slideways of the first drawer slide have a bowed lateral portion, said entire bowed lateral portion defining a curve having a generally constant radius of curvature bowed towards the slideways of the second drawer slide, the bowed lateral portion including a contact area in direct sliding contact with the slideways of the second drawer slide.

2. The telescopic drawer slide of claim 1, wherein the slideways of the first drawer slide are slightly concave inward.

3. The telescopic drawer slide of claim 1, wherein the bowed lateral portion of the first drawer slideways provides pockets running along the longitudinal length of the first drawer slide along edges of the bowed lateral portion.

4. The telescopic drawer slide of claim 3, wherein the pockets provide reservoirs for lubricating material.

5. The telescopic drawer slide of claim 3, wherein the pockets provide a depository for minute particles of materials produced during use of the slide.

6. The telescopic drawer slide of claim 1, wherein the first drawer slide includes a plurality of holes for attachment.

7. The telescopic drawer slide of claim 1, wherein at least one bracket is attached to the first drawer slide for attachment.

8. The telescopic drawer slide of claim 1, wherein the slideways of the first drawer slide further comprise a vertical portion.

9. The telescopic drawer slide of claim 1, wherein the slideways of the second drawer slide further comprise a vertical portion.

10. The telescopic drawer slide of claim 1, wherein the second drawer slideways are not concave inward.

11. The telescopic drawer slide of claim 1, wherein the second drawer slideways are flat.

12. The telescopic drawer slide of claim 10, wherein the inside corners of the second drawer slideways comprise sharp corners.

13. The telescopic drawer slide of claim 12, wherein the outside corners of the second drawer slideways are curved.

14. The telescopic drawer slide of claim 12, wherein the center of the second drawer web comprises a hat section.

15. The telescopic drawer slide of claim 14, wherein the third drawer web comprises an inner hat section.

16. The telescopic drawer slide of claim 15, wherein the inner hat section is sufficiently raised to prevent contact between the hat sections of the second and the third drawer slides.

17. The telescopic drawer slide of claim 1, wherein the third drawer web includes a plurality of holes for attachment.

18. The telescopic drawer slide of claim 1, wherein the third drawer slide includes an edge sliding on the slideways of the second drawer slide.

19. The telescope drawer slide of claim 1, wherein the bowed lateral portion contact area is at the top of the curve in a middle of the slideways.

* * * * *